US010824183B1

(12) United States Patent
Cruz-Pérez

(10) Patent No.: US 10,824,183 B1
(45) Date of Patent: Nov. 3, 2020

(54) CONTROL KNOB ASSEMBLY FOR A COOKTOP APPLIANCE

(71) Applicant: Haier US Appliance Solutions, Inc., Wilmington, DE (US)

(72) Inventor: Josué Cruz-Pérez, LaFayette, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/703,972

(22) Filed: Dec. 5, 2019

(51) Int. Cl.
*G05G 1/12* (2006.01)
*F24C 7/08* (2006.01)

(52) U.S. Cl.
CPC ..... *G05G 1/12* (2013.01); *F24C 7/085* (2013.01); *G05G 2700/24* (2013.01)

(58) Field of Classification Search
CPC ... G05G 1/08; G05G 1/10; G05G 1/12; F24C 7/08; H01H 3/10; H01H 3/08; H01H 19/14; H03J 1/14
See application file for complete search history.

(56) References Cited

U.S. PATENT DOCUMENTS

| | | | | | |
|---|---|---|---|---|---|
| 1,477,785 | A * | 12/1923 | Szukalski, Jr. | ..... | G05G 1/12 74/553 |
| 4,050,265 | A * | 9/1977 | Drennen | ..... | G05G 1/10 464/96 |
| 4,334,492 | A * | 6/1982 | Klingler | ..... | G05G 1/10 116/309 |
| 9,384,921 | B2 * | 7/2016 | Bekaert | ..... | B60K 37/06 |
| 2017/0252251 | A1 * | 9/2017 | Williams | ..... | H01H 3/08 |

FOREIGN PATENT DOCUMENTS

| | | | | | |
|---|---|---|---|---|---|
| CN | 206991155 | U | 2/2018 | | |
| GB | 787681 | A * | 12/1957 | ..... | G05G 1/12 |
| WO | WO2018054801 | A1 | 3/2018 | | |

OTHER PUBLICATIONS

Amazon, Dial Knob https://www.amazon.com/dp/B07M6V7LVT/ref=psdc_13397451_t4_B077BK6MKG, 7 pages.

* cited by examiner

*Primary Examiner* — Richard W Ridley
*Assistant Examiner* — Brian J McGovern
(74) *Attorney, Agent, or Firm* — Dority & Manning, P.A.

(57) ABSTRACT

A control knob assembly for a cooktop appliance includes a control knob having a plastic outer shell defining a cavity and a boss extending from the outer shell through the cavity. A steel weight is positioned within the cavity around the boss for adding mass to the control knob and a locking mechanism, such as a lock washer, is positioned around the boss to secure the weight within the cavity.

18 Claims, 3 Drawing Sheets

CONTROL KNOB ASSEMBLY FOR A COOKTOP APPLIANCE

FIELD OF THE INVENTION

The present subject matter relates generally to cooktops appliances and more particularly to weighted control knobs for cooktop appliances.

BACKGROUND OF THE INVENTION

Control knobs are commonly used on a variety of commercial and residential appliances to control an operating condition of the appliance. Control knobs are particularly common on cooking appliances, such as stoves or cooktops. Various shapes and sizes can be used depending upon, e.g., the intended application, aesthetics, and other factors.

For example, cooktops traditionally have at least one heating element positioned at a cooktop surface for use in heating or cooking an object, such as a cooking utensil and its contents. The at least one heating element may heat a cooking utensil directly through induction heating or may use another heat source such as electrically resistant coils or gas burners. Control knobs are typically used to adjust the power level of the heating element—and thus the amount of heat delivered by the heating element. In other appliances, e.g., ovens, washing machines, clothes dryers, etc., control knobs are often used to select an operating mode of the appliance, such as "bake" or "broil" for ovens, "cotton" or "permanent press" for clothes dryers, etc.

Control knobs are typically constructed from plastic or a similar material for improved durability and reduced costs. However, plastic is often very lightweight, which may lead a user of the knob to consider the control knob cheap and/or fragile. Therefore, weights are commonly installed in the plastic knob to provide sufficient mass to the control knob for a more robust, high quality feel. Such weights are commonly attached using an adhesive. However, use of such adhesives is costly, time consuming, and may result in limited knob lifetime. Alternative means for attaching the weights include screws, but screws often require bosses to be defined in the knob and require additional time to assemble properly.

Accordingly, a control knob assembly with improved weight and feel would be useful. More particularly, a control knob assembly that includes features for adding weight in a quick and cost-effective manner would be particularly beneficial.

BRIEF DESCRIPTION OF THE INVENTION

Aspects and advantages of the invention will be set forth in part in the following description, may be apparent from the description, or may be learned through practice of the invention.

In one aspect of the present disclosure, a control knob assembly is provided, including a control knob including an outer shell defining a cavity and a boss extending from the outer shell through the cavity. A weight is positioned within the cavity around the boss and a locking mechanism positioned around the boss to secure the weight within the cavity.

In another aspect of the present disclosure, a cooktop appliance is provided, including a cooking surface including a heating source, a control panel defining an aperture, and a control knob assembly for regulating a power level of the heating source. The control knob assembly includes a control knob including an outer shell defining a cavity and a boss extending from the outer shell through the cavity, a weight positioned within the cavity around the boss, and a locking mechanism positioned around the boss to secure the weight within the cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
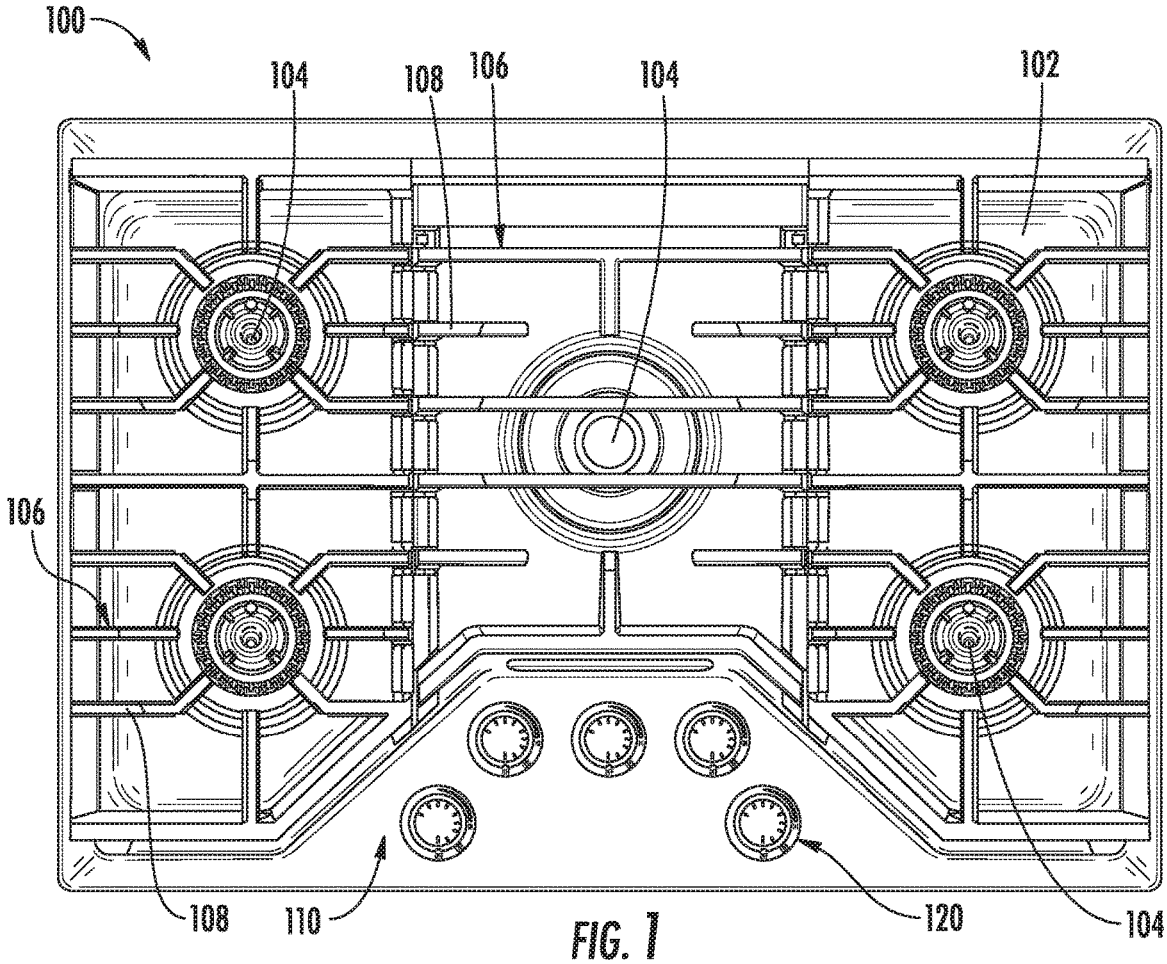
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a control knob assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary control knob assemblies described below may be used on other types of cooking appliances, such as ranges or oven appliances, or on dishwashing appliances, washing machines, clothes dryers, or any other consumer or commercial appliance that operates at least in part based on user input through a control knob. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated embodiment, cooktop appliance 100 is a gas cooktop and heating elements 104 are gas burners. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 106 configured to support a cooking utensil, such as a pot, pan, etc. In general, grates 106 include a plurality of elongated members 108, e.g., formed of cast metal, such as cast iron. The cooking utensil may be placed on the elongated members 108 of each grate 106 such that the cooking utensil rests on an upper surface of elongated members 108 during the cooking process. Heating elements 104 are positioned underneath the various grates 106 such that heating elements 104 provide thermal energy to cooking utensils above top panel 102 by combustion of fuel below the cooking utensils.

Although heating elements 104 are illustrated herein as gas burners, it should be appreciated that according to various alternative embodiments, heating elements 104 may employ any suitable method for heating or cooking an object, such as a cooking utensil and its contents. For example, cooktop appliance 100 may be a gas cooktop, a radiant smooth top cooktop, an electric coil cooktop, an induction cooktop, etc. Thus, according to alternative embodiments, heating elements 104 use another heat transfer method, such as electric coils or induction elements, to heat the cooking utensil. Moreover, the configuration of cooktop appliance 100 and top panel 102 may vary according to the type of cooktop and heating elements. For example, in smooth top (e.g., glass) and induction cooktop applications, top panel 102 may directly support the cooking utensils, such that no grate 106 is needed. In this regard, top panel 102 may be a constructed of a ceramic glass for supporting the cooking utensil and heating element 104 may be positioned within or below top panel 102. By contrast, in an electric coil cooktop, the heating element 104 (e.g., the electrical coil) directly supports the cooking utensil. Other configurations are possible and within the scope of the present subject matter.

Figure 2:
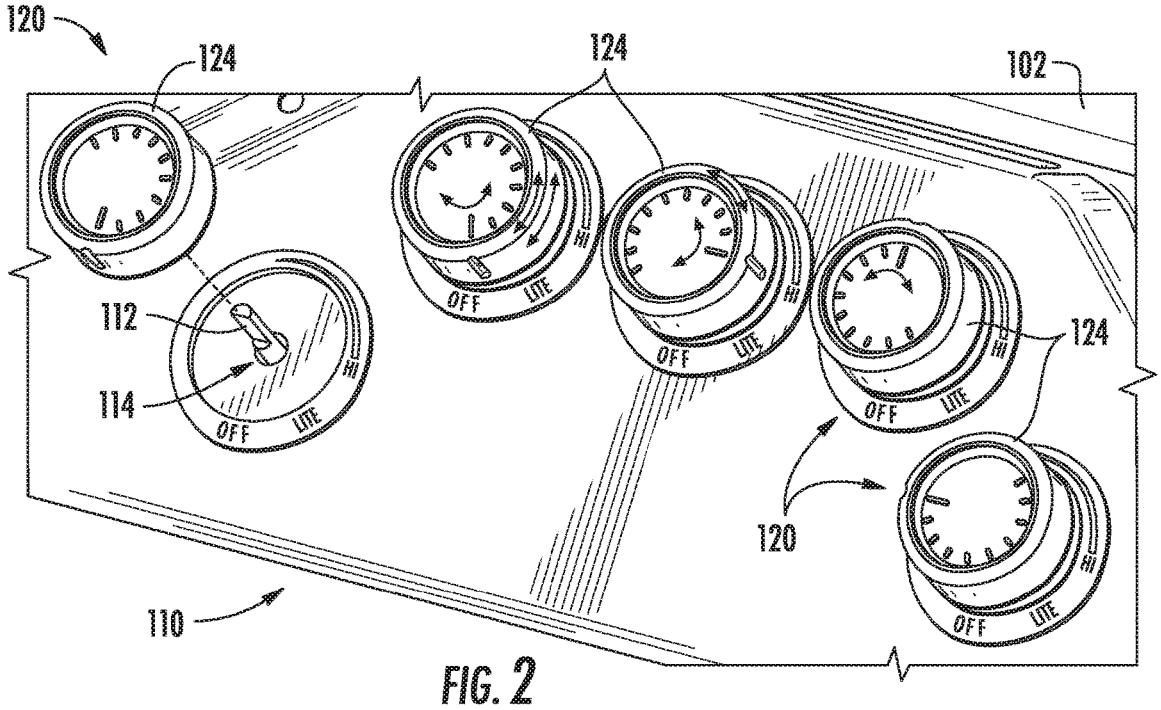
FIG. 2 provides a perspective view of a control panel of the exemplary cooktop appliance of FIG. 1.

According to the illustrated exemplary embodiment, a user interface panel or control panel 110 is located within convenient reach of a user of cooktop appliance 100. As shown in FIG. 2, cooktop appliance 100 includes a control stem or keyed shaft 112 that is operably coupled to a power regulating device (not shown) and that passes through an aperture 114 in control panel 110. Cooktop appliance 100 may further include a control knob assembly 120 that is coupled to keyed shaft 112 for adjusting the power regulating device. For example, as described in detail below, keyed shaft 112 may be keyed for receipt within control knob assemblies 120.

For this exemplary embodiment, control panel 110 includes control knob assemblies 120 that are each associated with one of heating elements 104. Control knob assemblies 120 allow the user to activate each heating element 104 and regulate the amount of heat input each heating element 104 provides to a cooking utensil located thereon. In this regard, control knob assembly 120 is generally rotatable about the axial direction A and manipulated by a user for regulating the amount of heat delivered by a corresponding heating element 104. Control panel 110 may also be provided with one or more graphical display devices, such as a digital or analog display device designed to provide operational feedback to a user.

According to the illustrated embodiment, control knob assemblies 120 are located within control panel 110 of cooktop appliance 100. However, it should be appreciated that this location is used only for the purpose of explanation, and that other locations and configurations of control panel 110 and control knob assemblies 120 are possible and within the scope of the present subject matter. Indeed, according to alternative embodiments, control knob assemblies 120 may instead be located directly on top panel 102 or elsewhere on cooktop appliance 100, e.g., on a backsplash, front bezel, or any other suitable surface of cooktop appliance 100.

Figure 3:
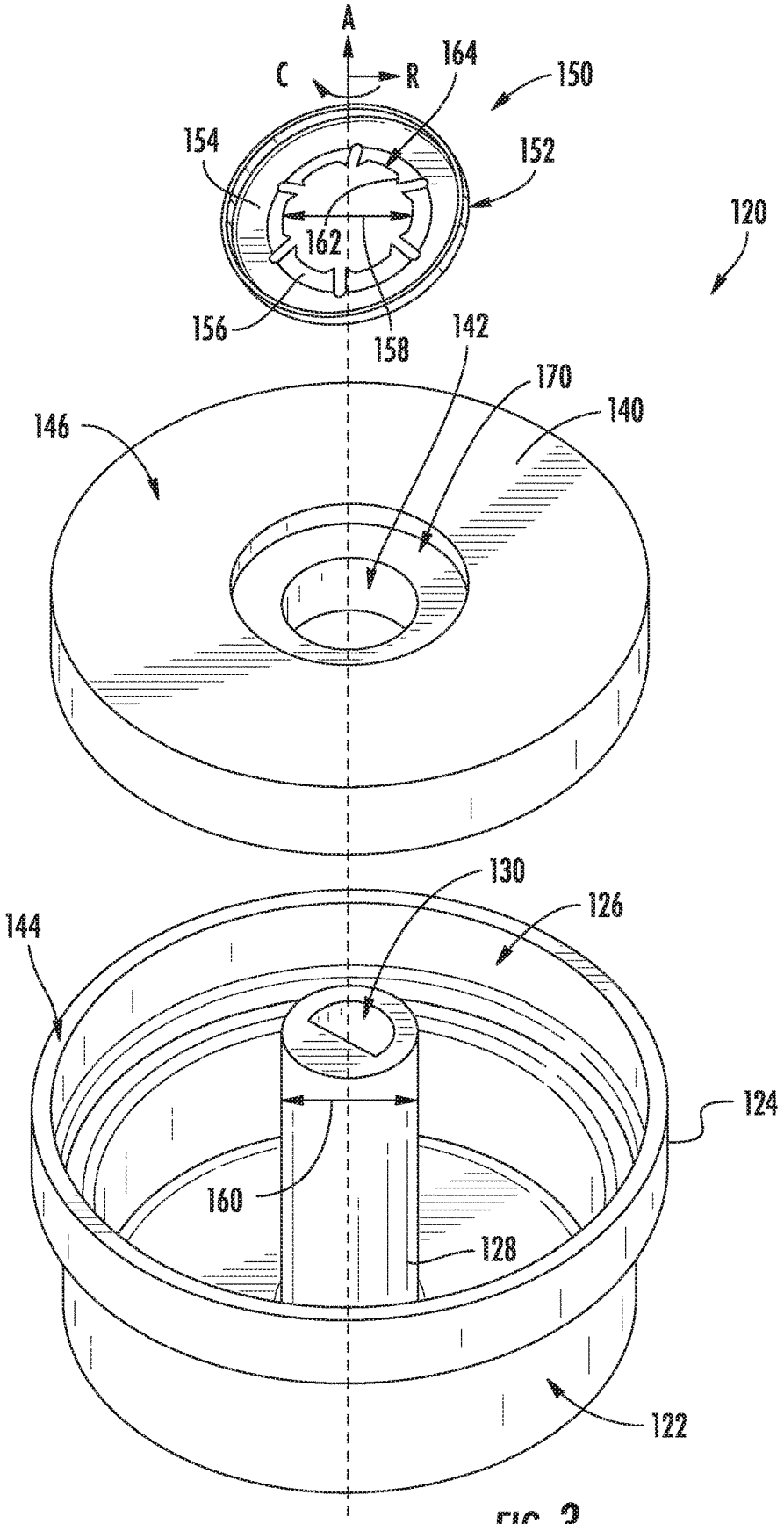
FIG. 3 provides an exploded perspective view of a control knob assembly that may be used with the exemplary cooktop appliance of FIG. 1 according to an exemplary embodiment of the present subject matter.
Figure 4:
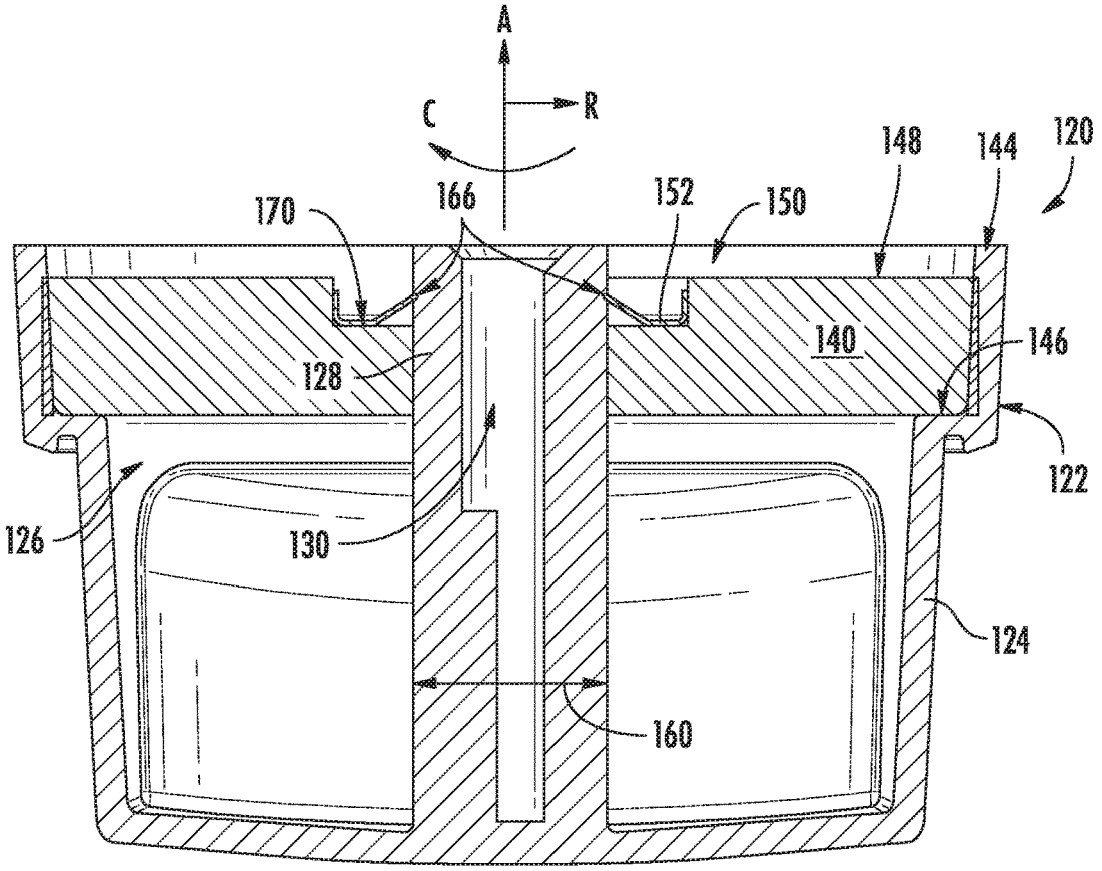
FIG. 4 provides a cross sectional view of the exemplary control knob assembly of FIG. 3.
Figure 5:
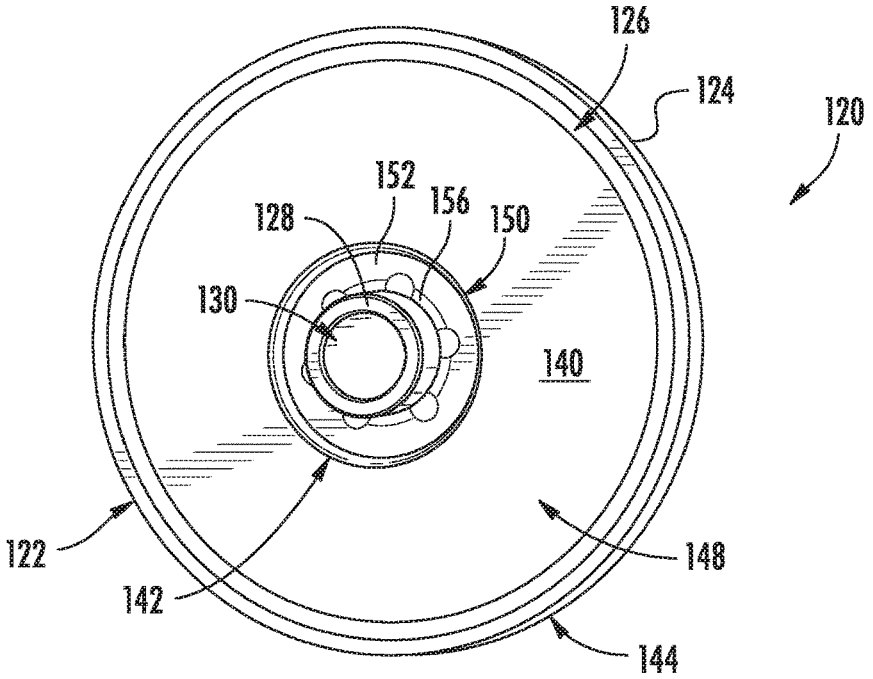
FIG. 5 provides a bottom perspective view of the exemplary control knob assembly of FIG. 3.

Referring now generally to FIGS. 3 through 5, a control knob assembly 120 that may be used with cooktop appliance 100 will be described in more detail. Although the discussion below refers to an exemplary control knob assembly 120, it should be appreciated that the features and configurations described may be used for other knob assemblies in other cooking appliances or consumer appliances as well. For example, control knob assembly 120 may be positioned elsewhere within cooktop appliance 100, may have different components or configurations, etc. Other variations and modifications of the exemplary embodiment described below are possible, and such variations are contemplated as within the scope of the present subject matter.

FIG. 3 provides an exploded view of control knob assembly 120, FIG. 4 provides a cross-sectional view of control knob assembly 120, and FIG. 5 provides a bottom perspective view of control knob assembly 120. As shown, control knob assembly 120 generally defines an axial direction A, a radial direction R, and a circumferential direction C. When control knob assembly 120 is installed on cooktop appliance 100, axial direction A may correspond to a rotational axis of keyed shaft 112.

According to the illustrated embodiment, control knob assembly 120 includes a control knob 122 that may be manipulated by a user of cooktop appliance 100 to rotate keyed shaft 112 and regulate the output of a corresponding heating element 104. Although control knob 122 is illustrated herein as a single plastic shell, it should be appreciated that according to exemplary embodiments, control knob 122 may be a multi-piece assembly including a variety of indicators, light assemblies, words, logos, and other features for improving user interaction.

In addition, as used herein, control knob 122 may refer to any configuration of rotary dial, and not just one having a circular base, as shown in the figures. For example, the present disclosure contemplates exemplary embodiments wherein control knobs 122 have a rectangular base, an oval base, or any other shape having one or more curved lines, straight lines, or both. Furthermore, although control knob 122 is illustrated as controlling the power level of heating element 104 of cooktop appliance 100, one skilled in the art will appreciate that aspects of the present disclosure may be used to control alternative operating conditions on other appliances. For example, according to alternative embodiments, control knob 122 may be used to regulate a wash time on a washing machine or to select a wash cycle on a dishwasher.

According to exemplary embodiments, control knob 122 may be formed from any material which is sufficiently rigid to permit manipulation of keyed shaft 112 during operation of cooktop appliance 100. In addition, it is preferable that control knob 122 is formed from a material that is suitably resistant to high-temperature operation associated with cooktop appliance 100. For example, control knob 122 may be formed by injection molding, e.g., using a suitable plastic material, such as polypropylene, injection molding grade high impact polystyrene (HIPS), acrylonitrile butadiene styrene (ABS), or any other suitable polymeric material. Alternatively, according to the exemplary embodiment, these components may be compression molded, e.g., using sheet molding compound (SMC) thermoset plastic or other thermoplastics. According still other embodiments, control knob 122 may be formed or fabricated from metal or any other suitably rigid material using any suitable manufacturing method, such as machining.

As shown in the figures, control knob 122 may generally include an outer shell 124 that defines an internal cavity 126. In addition, control knob 122 may include a boss 128 that extends from outer shell 124 through cavity 126. More specifically, according to the illustrated embodiment, boss 128 extends along the axial direction A and defines a keyed slot 130 at its distal end for receiving keyed shaft 112. Control knob may include internal cavity 126, for example, to reduce material usage, reduce costs, reduce manufacturing defects, etc. However, as noted above, hollow control knobs are commonly too lightweight, resulting in a flimsy or cheap feel, particularly when such control knobs are constructed from plastic. Thus, aspects of the present subject matter are directed towards the inclusion of additional weight or mass on control knob assembly 120 for improved feel, rigidity, and performance.

Specifically, control knob assembly 120 may further include a weight 140 that is positioned within cavity 126 around boss 128. In this regard, as best shown in FIG. 3, weight 140 may be an annular piece of steel or other suitable metal. According to alternative embodiments, weight 140 may be constructed from any other suitably heavy material. As shown, weight 140 defines a central aperture 142 through which boss 128 passes when weight 140 is installed in control knob assembly 120. According to exemplary embodiments, weight 140 may have any suitable shape for fitting within cavity 126. For example, weight 140 may have the same shape and size as cavity 126. According to the illustrated embodiment, weight 140 is positioned toward a bottom 144 of outer shell 124. In this regard, for example, outer shell 124 may define a shoulder 146 on which weight 140 may be seated. When weight 140 is so seated on the shoulder 146, a bottom surface 148 of weight 140 may sit flush with bottom 144 of outer shell 124. Other suitable sizes and positions of weight 140 are possible and within the scope of the present subject matter.

Referring still specifically to FIGS. 3 through 5, control knob assembly 120 may further include a locking mechanism 150 that is positioned around boss 128 and is generally configured for securing weight 140 within cavity 126. Although an exemplary locking mechanism 150 is described below, it should be appreciated that locking mechanism 150 may be any mechanism, device, or feature that is suitable for securing weight 140 within cavity 126.

According to the illustrated embodiment, locking mechanism 150 is a washer 152 including a circular rim 154 and a plurality of projections 156 that are spaced apart circumferentially on an inner surface of circular rim 154 and extend from circular rim 154 inward along a radial direction R for engaging boss 128. In addition, according to an exemplary embodiment, projections 156 define an inner diameter 158 (e.g., defined when locking mechanism 150 is not installed on boss 128) that is less than an outer diameter 160 of boss 128. In addition, as best shown in FIG. 3, locking mechanism 150 may include a plurality of teeth 162 that are positioned on a distal end 164 of projections 156 for engaging boss 128. In this manner, projections 156 engage and bite into boss 128 to securely attach weight 140 within cavity 126. Specifically, as illustrated for example in FIG. 4, teeth 162 may bite into and deform boss 128, such that projections 156 and teeth 162 are seated within deformations 166 to secure locking mechanism 150 to boss 128.

Notably, in order to form a secure engagement with boss 128, it may be desirable that locking mechanism 150 is permitted to flex slightly. In this regard, for example, locking mechanism 150 may be formed from any suitable material that has slight resiliency, such as spring steel. According to alternative embodiments, locking mechanism 150 may be formed with any other suitable material and may have any suitable shape, size, or construction. For example, locking mechanism may be a rigid washer or any other suitable mechanical device for securing weight 140 within cavity 126.

As best shown in FIG. 3, weight 140 may further define an annular recess 170 at bottom surface 148 of weight 140. Annular recess 170 may be configured for receiving the locking mechanism 150 when installed. For example, according to the illustrated embodiment, locking mechanism 150 may sit flush with bottom surface 148 of weight 140 when locking mechanism 150 is installed on boss 128 to secure weight 140 within cavity 126.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A control knob assembly comprising:

a control knob comprising an outer shell defining a cavity and a boss extending from the outer shell through the cavity, the boss being configured to receive a shaft;

a weight positioned within the cavity around the boss; and a locking mechanism positioned around the boss to secure the weight within the cavity, wherein the locking mechanism is a washer with a circular rim and a plurality of projections that extend from the circular rim inward along a radial direction for engaging the boss.

2. The control knob assembly of claim 1, wherein the outer shell defines a shoulder, the weight being seated against the shoulder.

3. The control knob assembly of claim 1, wherein an inner diameter of the plurality of projections is less than an outer diameter of the boss before the locking mechanism is positioned on the boss.

4. The control knob assembly of claim 1, wherein the locking mechanism comprises:

a plurality of teeth that extend from a distal end of at least one the plurality of projections to engage the boss.

5. The control knob assembly of claim 4, wherein the plurality of teeth form deformations in the boss.

6. The control knob assembly of claim 1, wherein the weight is annular and defines a central aperture through which the boss passes.

7. The control knob assembly of claim 1, wherein the weight defines an annular recess for receiving the locking mechanism.

8. The control knob assembly of claim 7, wherein the locking mechanism sits flush with a bottom of the weight when positioned in the annular recess.

9. The control knob assembly of claim 1, wherein the knob is constructed from plastic.

10. The control knob assembly of claim 1, wherein the weight is constructed from metal.

11. The control knob assembly of claim 1, wherein the locking mechanism is constructed from spring steel.

12. The control knob assembly of claim 1, wherein the boss defines a keyed receiving slot for receiving a keyed portion of the shaft of an appliance.

13. The control knob assembly of claim 12, wherein the appliance is an oven appliance.

14. A cooktop appliance, comprising:

a cooking surface including a heating source;

a control panel defining an aperture; and a control knob assembly for regulating a power level of the heating source, the control knob assembly comprising:

a control knob comprising an outer shell defining a cavity and a boss extending from the outer shell through the cavity, the boss being configured to receive a shaft of the cooktop appliance;

a weight positioned within the cavity around the boss; and a locking mechanism positioned around the boss to secure the weight within the cavity, wherein the locking mechanism is a washer with a circular rim and a plurality of projections that extend from the circular rim inward along a radial direction for engaging the boss.

15. The cooktop appliance of claim 14, wherein an inner diameter of the plurality of projections is less than an outer diameter of the boss before the locking mechanism is positioned on the boss.

16. The cooktop appliance of claim 14, wherein the locking mechanism comprises:

a plurality of teeth that extend from a distal end of at least one the plurality of projections to engage and deform the boss.

17. The cooktop appliance of claim 14, wherein the weight is annular and defines a central aperture through which the boss passes, the weight defining an annular recess for receiving the locking mechanism.

18. The cooktop appliance of claim 14, wherein the knob is constructed from plastic, the weight is constructed from metal, and the locking mechanism is constructed from spring steel.

* * * * *